US008322083B1

(12) United States Patent
Kessler

(10) Patent No.: US 8,322,083 B1
(45) Date of Patent: Dec. 4, 2012

(54) ARTICULATING DOWNSPOUT ASSEMBLY

(75) Inventor: Wayne Kessler, Edelstein, IL (US)

(73) Assignee: Lynch Aluminum Mfg. Co., Peoria, IL (US)

( * ) Notice: Subject to any disclaimer, the term of this patent is extended or adjusted under 35 U.S.C. 154(b) by 0 days.

(21) Appl. No.: 13/103,251

(22) Filed: May 9, 2011

(51) Int. Cl.
*E04D 13/08* (2006.01)

(52) U.S. Cl. ..... 52/16; 137/615; 16/268

(58) Field of Classification Search ..... 52/12, 16; 16/225, 268; 137/615
See application file for complete search history.

(56) References Cited

U.S. PATENT DOCUMENTS

| | | | | | |
|---|---|---|---|---|---|
| 2,975,805 | A | * | 3/1961 | Horn | 239/508 |
| 3,060,952 | A | * | 10/1962 | Bystrom | 137/67 |
| 3,208,478 | A | * | 9/1965 | Baines | 138/162 |
| 3,316,928 | A | | 5/1967 | Weakley | |
| 3,375,851 | A | | 4/1968 | Henry et al. | |
| 3,481,366 | A | * | 12/1969 | Mortonson | 137/873 |
| 3,911,954 | A | | 10/1975 | Johnson | |
| 4,270,572 | A | * | 6/1981 | Jarzynka | 137/615 |
| 4,645,380 | A | * | 2/1987 | Hambrick et al. | 405/220 |
| 4,724,579 | A | * | 2/1988 | Ng | 16/260 |
| 5,375,891 | A | * | 12/1994 | Sicotte et al. | 285/148.22 |
| 5,511,829 | A | * | 4/1996 | Sicotte et al. | 285/148.22 |
| 5,658,092 | A | * | 8/1997 | Sweers | 405/118 |
| 5,735,085 | A | | 4/1998 | Denooy | |
| 6,223,777 | B1 | * | 5/2001 | Smith et al. | 138/109 |
| 6,240,680 | B1 | | 6/2001 | Estes | |
| 6,827,103 | B2 | | 12/2004 | Cheremshynski et al. | |
| 7,017,614 | B2 | * | 3/2006 | Handley | 138/109 |
| 7,411,153 | B2 | * | 8/2008 | Radtke | 219/130.1 |
| 7,677,271 | B2 | * | 3/2010 | Boettner et al. | 138/119 |
| 7,958,680 | B2 | * | 6/2011 | DeNooy | 52/97 |
| 2004/0040219 | A1 | * | 3/2004 | Bacik et al. | 52/11 |
| 2007/0204522 | A1 | * | 9/2007 | Tredennick | 52/12 |

* cited by examiner

*Primary Examiner* — Brian Glessner
*Assistant Examiner* — Adriana Figueroa
(74) *Attorney, Agent, or Firm* — Bruce J. Bowman

(57) ABSTRACT

An articulating downspout assembly for a downspout system of a building has an elbow component and an end component each having an integrated or integral configuration that cooperatively join with each other to form a hinge. The hinge allows the end component to pivot between a prone position and an upright position. In the upright position the end component is at an angle relative to the elbow component such that a downspout extension section coupled to the end component leans toward and/or against a vertical downspout portion of the building's downspout system. This prevents the end component and thus the downspout extension from spontaneously falling (pivoting) back to the prone position. The integrated configuration of the elbow component is characterized by one or more configured slots while the integrated configuration of the end component is characterized by one or more configured tabs. Preferably, the integrated configuration of one or more configured slots of the elbow component is formed in an upper surface of an end portion of the elbow component, while the integrated configuration of one or more configured tabs of the end component is formed in and projects from an upper end surface of the end component. The resulting hinge between the elbow component and the end component does not stress the material (e.g. metal) of either the elbow component or the end component.

14 Claims, 10 Drawing Sheets

ARTICULATING DOWNSPOUT ASSEMBLY

BACKGROUND OF THE INVENTION

1. Field of the Invention

The present invention relates to downspout systems for channeling water away from buildings and the like and, more particularly, to articulating downspout assemblies that provide a pivoting end downspout section.

2. Background Information

Downspout systems for buildings have been in use for many years. A conventional downspout system has one or more vertical downspout sections that extend downwardly from a rain gutter to the ground. An angled or elbow section connects to the lower end of the vertical downspout section and includes an extension section of a given length that directs the water away from the building. The main goal of a downspout system is to direct as much water away from the building as possible in order to prevent water related building problems such as foundation erosion and the like. Because of this, downspout extension sections typically extend a fair distance from the building.

In order to mow, trim or otherwise landscape under and around the lengthy extension section, it is then necessary for the downspout extension section to either be temporarily removed or somehow repositioned out of the way. Because conventional downspout systems are typically made from aluminum or other rigid material they are not intended to bend. In order to overcome these obstacles various articulating downspout systems have been devised that provide a downspout extension which is hinged to the angled section of the vertical downspout section so that when mowing, trimming or landscaping close to the building, the downspout extension may be pivoted/flipped upwardly to provide ready access to the area under the extension. Other articulating downspout systems provide automatic downward pivoting of a downspout extension when it rains from a normally upright position to a prone position. In this case, the downspout extension is on the ground (prone position) only when it is directing water away from the building. Thus during times when one would mow, trim, landscape of the like, the downspout extension is in the upright position. Moreover, some prior art articulated downspout systems include fasteners that temporarily hold the downspout extension in the upright position in order to keep them from falling.

In all cases the prior art articulated downspout systems/arrangements fall into four categories, namely: 1) connection via a pivot pin that extends through the two articulating sections; 2) connection via an external hinge that attaches to each articulating section; 3) connection via a flexible section that is coupled between the two articulating sections; and 4) connection via independent side pivot pins/pin structures that independently couple each side of each articulating section to each other. In all cases, however, the prior art systems/arrangements are not easy to manufacture, install or maintain due to many factors such as the number of components required to implement the arrangement. Moreover, such prior art systems are generally cumbersome, unsightly and may not work.

What is thus needed is an articulating downspout assembly that is easy to manufacture, install, use and maintain.

Accordingly, there presently exists a need for an improved articulating downspout assembly.

SUMMARY OF THE INVENTION

An articulating downspout assembly for a downspout system of a building includes components having integrated configurations which form a pivot between the components when coupled.

The articulating downspout assembly is characterized by an elbow component and an end component each having one of two integrated configurations that cooperatively couple one another to form a hinge. One integrated configuration comprises a configured slot configuration while another integrated configuration comprises a configured tab configuration. The configured slot and tab configurations cooperate with each other to form the hinge.

The hinge allows the end component to pivot between a prone (non-articulated) position and an upright (articulated) position. In the upright position the end component leans inwardly from a 90° angle towards the vertical downspout section of a building's downspout system. This prevents the end component and thus any downspout extension connected to the end component to fall or pivot back to the non-articulated position.

The integrated configuration of the elbow component is defined by a structure having one or more configured slots while the integrated configuration of the end component is defined by a structure having one or more configured tabs. The configured slots of the elbow component are formed in an upper surface of a lower section of the elbow component, while the configured tabs of the end component are formed in and project from an upper end surface of the end component.

The present invention thus provides an articulating downspout assembly that is easy to manufacture, install, use and maintain.

BRIEF DESCRIPTION OF THE DRAWINGS

The above mentioned and other features, advantages and objects of this invention, and the manner of attaining them, will become apparent and the invention itself will be better understood by reference to the following description of embodiments of the invention taken in conjunction with the accompanying drawings, wherein.

Like reference numerals indicate the same or similar parts throughout the several figures.

A description of the features, functions and/or configuration of the components depicted in the various figures will now be presented. It should be appreciated that not all of the features of the components of the figures are necessarily described. Some of these non-discussed features, if any, as well as discussed features are inherent from the figures. Other non discussed features may be inherent in component geometry and/or configuration.

DETAILED DESCRIPTION OF EMBODIMENTS OF THE INVENTION

Figure 1:
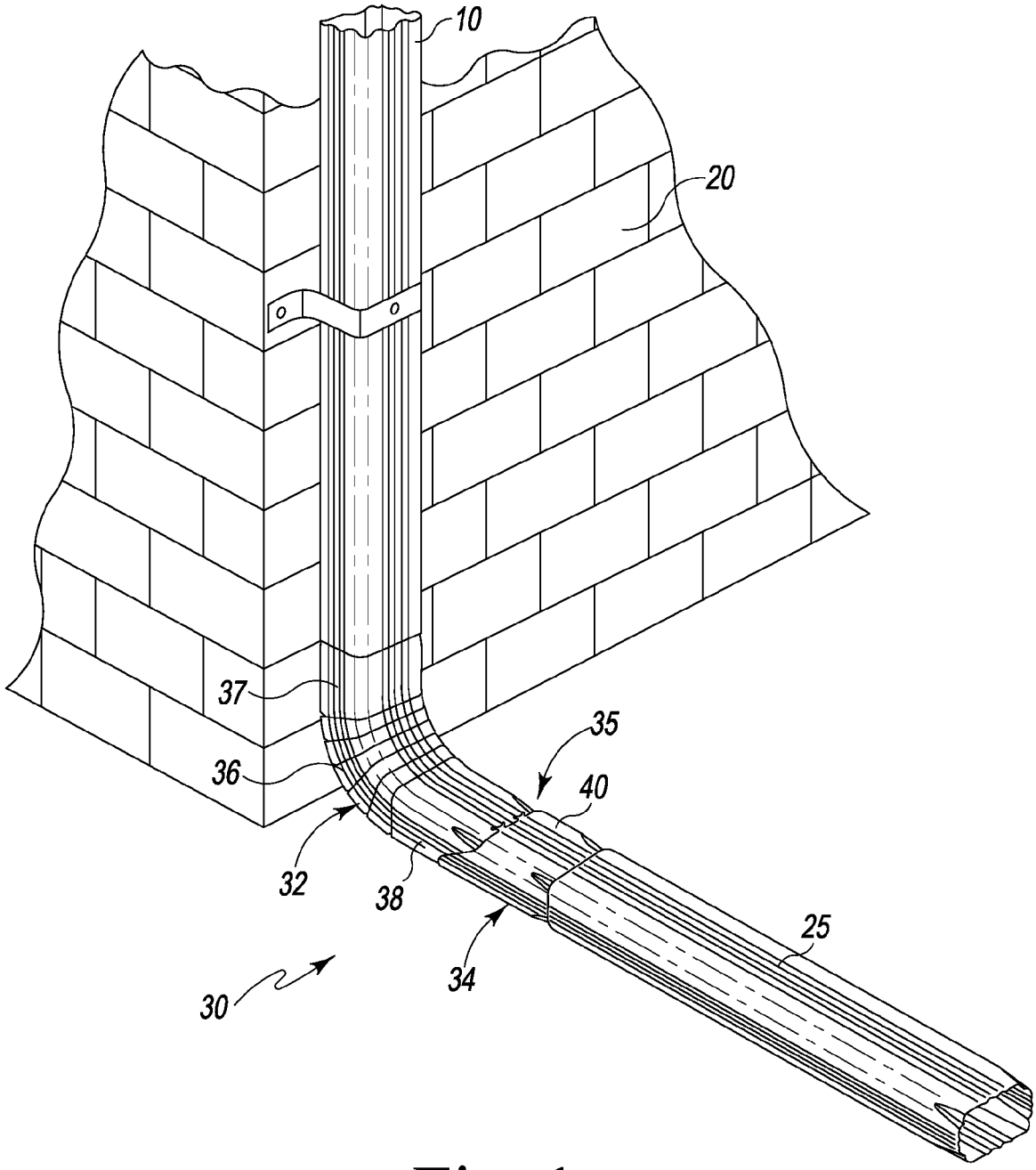
FIG. 1 is a perspective view of a lower portion of a vertical downspout of a building's downspout system having an articulating downspout assembly fashioned in accordance with the present principles coupled to the vertical downspout, the articulating downspout assembly shown in a non-articulated position with an end section coupled to and extending from the present articulated downspout assembly.

Referring to FIG. 1, there is depicted a portion of a building 20 on which is attached a vertical downspout 10 of the building's downspout system (not shown). An articulated downspout assembly 30, fashioned in accordance with the present principles, is shown connected to the vertical downspout 10. A downspout extension 25 is also shown connected to the present articulated downspout assembly 30. The articulated downspout assembly 30 is characterized by an elbow or elbow component 32 and an end or end component 34. The downspout extension 25 is coupled to the end component 34 and extends a fair length along the ground. It should be appreciated that the downspout extension 25 may be any length as desired. The present articulated downspout assembly 30, like the building's downspout assembly, is preferably made of aluminum, but other suitable materials may be used such as other metals, vinyl, composites or the like.

The elbow component 32 is defined by an angled or elbow section 36, an upper section 37 and a lower section 38. The upper section 37 is configured for connection with the end of the vertical downspout 10 such as is known in the art. The end component 34 is defined by a body or end section 40 that is connected to the lower section 38 of the elbow component 32 so as to form a pivot or hinge 35 between the elbow component 32 and the end component 34. Because the elbow component 32 is fixed to the vertical downspout 10 and is thus stationary, the end component 34 pivots about the hinge 35. The end section 40 may thus be considered an articulating section.

Figure 2:
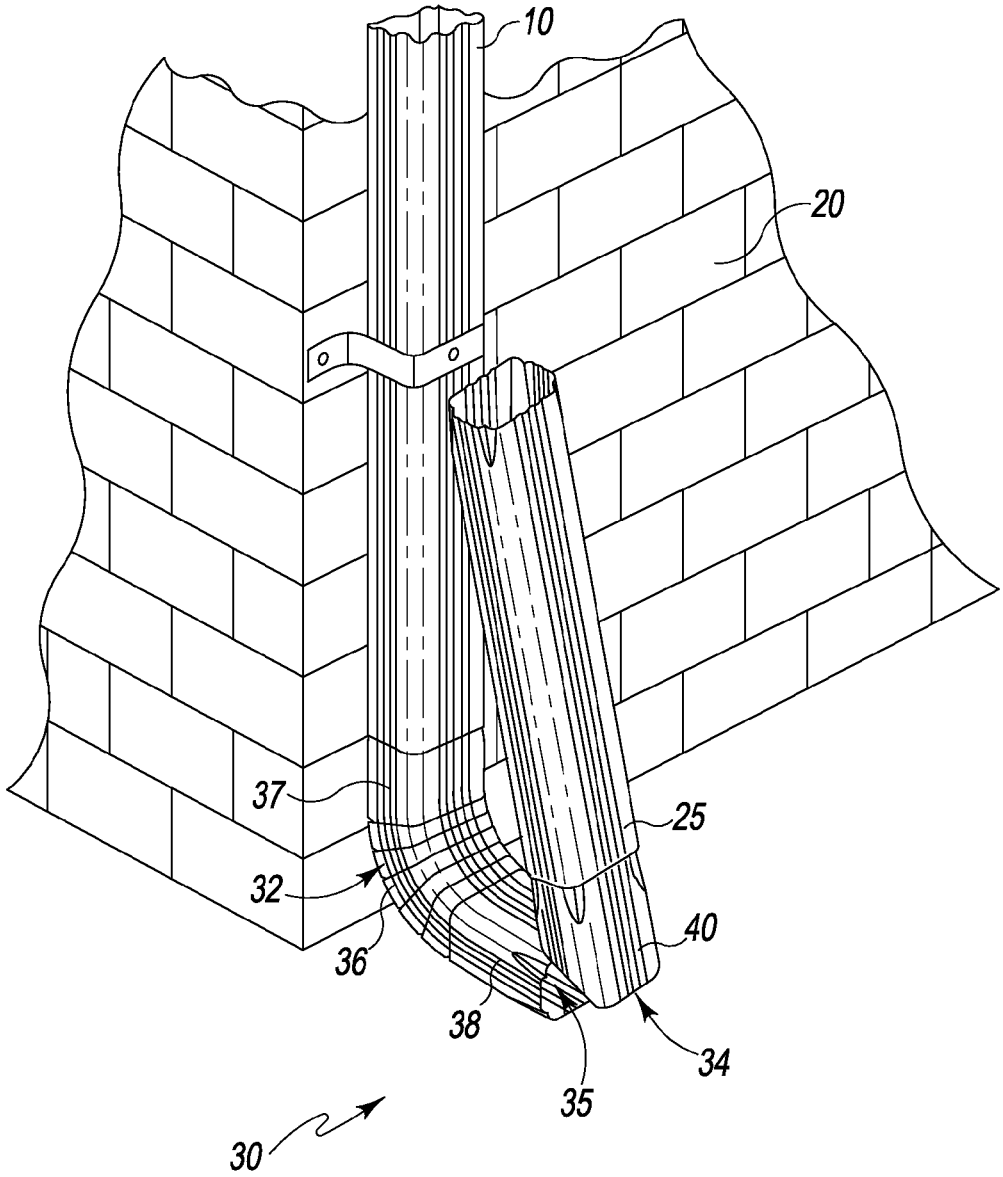
FIG. 2 is the perspective view of the hinged downspout assembly of FIG. 1 showing the articulating downspout assembly in an articulated position with the end section leaning toward and/or against the vertical downspout.

FIG. 1 depicts the articulating downspout assembly 30 in a non-articulated or prone position wherein the end component 34 is coaxial with the lower section 38 of the elbow component 32. In this position, the downspout extension 25 abuts or lies on the ground to provide water drainage. In FIG. 2, the articulating downspout assembly 30 is in an articulated, pivoted or upright position wherein the downspout extension 25 is leaning toward and/or is against the vertical downspout 10. In this position, the downspout extension 25 is away from the ground. As explained in greater detail below with reference to FIG. 5, the lower section 38 of the elbow component 32 is of a length sufficient to assist the downspout extension 25 in staying vertical or past vertical when hinged upward (i.e. in the upright position). The length of the present lower section 38 is thus longer than the typical downspout elbow section.

Figure 3A:
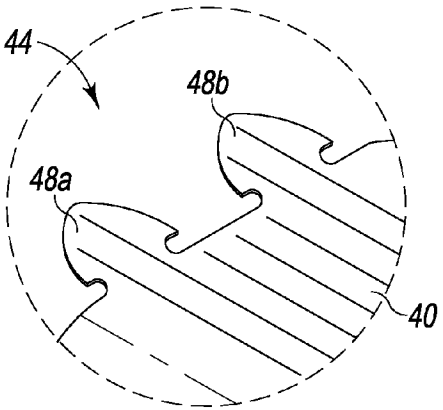
FIG. 3A is an enlargement of a portion of the articulating section of the present articulating downspout assembly particularly showing the tab configuration thereof.
Figure 3B:
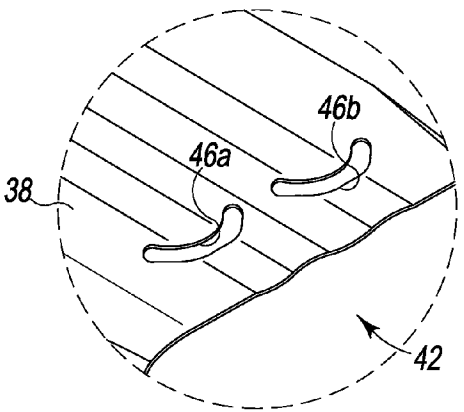
FIG. 3B is an enlargement of a portion of the elbow section of the present articulating downspout assembly particularly showing the slot configuration thereof.
Figure 3:
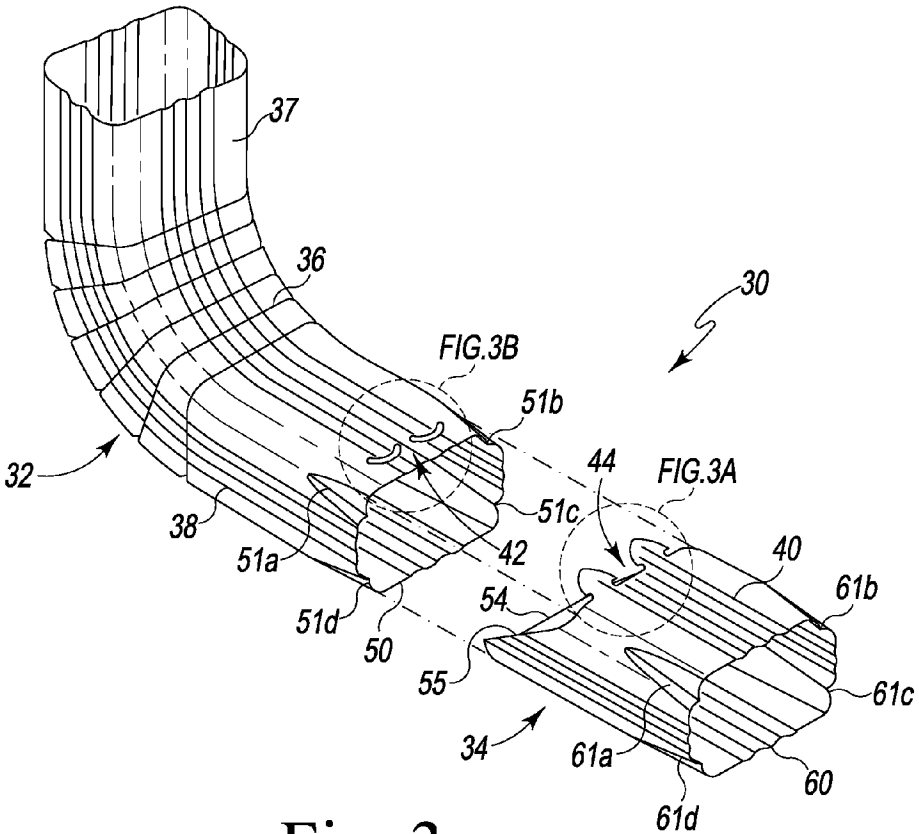
FIG. 3 is an exploded isometric view of the present articulating downspout assembly particularly showing the elbow section and the articulating section thereof.
Figure 6:
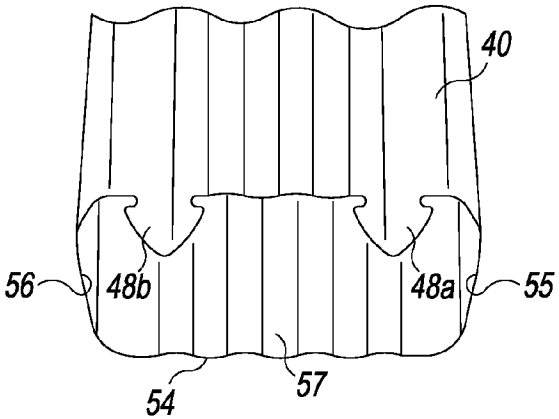
FIG. 6 is a partial view of the articulating section of the present articulating downspout assembly particularly showing the tab configuration of the end thereof.

With reference to FIGS. 3, 3A and 3B, the present articulated downspout assembly 30 is depicted in an exploded view to better show the two components 32, 34 in order to illustrate the sectional configuration thereof and the manner in which the two components are formed and join to create the pivot or hinge 35. The elbow component 32 has an integrated configuration 42 that provides one portion of the pivot 35 while the end component 34 has an integrated configuration 44 that provides another portion of the pivot 35. As best seen in FIG. 3B, the integrated configuration 42 comprises a configuration of configured slots (i.e. slot configuration 42) on an upper surface of the lower section 38 of the elbow component 32. The slot configuration 42 is depicted as two arced or crescent shaped slots 46*a* and 46*b*. It should be appreciated, however, that the slot configuration 42 may consist of one or more slots of different sizes, configurations and layouts. Examples of such alternate embodiments are shown and described herein and will be discussed below. As best seen in FIGS. 3A and 6, the integrated configuration 44 comprises a configuration of configured tabs (i.e. tab configuration 44) that extend or project from an upper end/end surface of the end section 40. The tab configuration 44 is depicted as two spade, spear or arrowhead shaped tabs 48*a*, 48*b*. It should be appreciated, however, that the tab configuration 44 may consist of one or more tabs of different sizes, configurations and layouts. The tab configuration 44 is thus received in the slot configuration 42. The slot and tab configurations are thus fashioned to cooperate with one another to provide a smooth operating hinge or pivot 35 that will easily assemble but not easily disassemble.

The slot and tab configurations 42, 44 have been currently identified as being a preferred embodiment for the integrated slot configuration and the integrated tab configuration in order to provide a hinge or pivot that will easily assemble but not easily disassemble. However, other tab and slot configurations may be used. Some alternative embodiments of the present articulating downspout assembly are depicted in FIGS. 7-14 which are described below.

Figure 4:
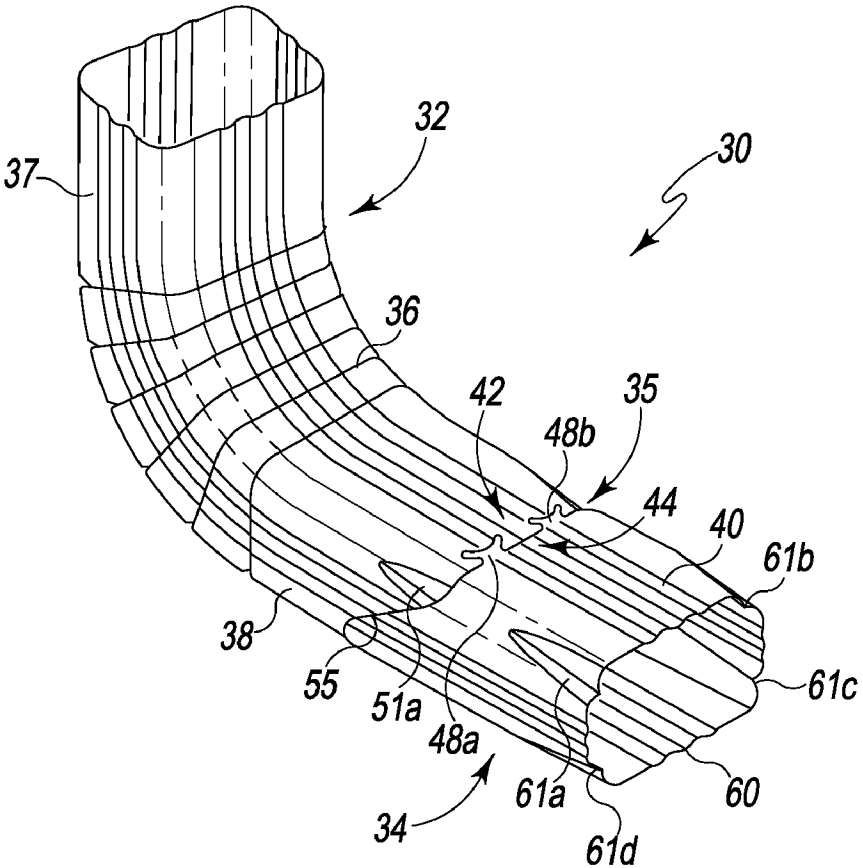
FIG. 4 is an isometric view of the assembled articulating downspout assembly with the articulating section thereof in a non-articulated position.

In accordance with an aspect of the present invention the open end 50 of the lower section 38 of the elbow component 32 has an indent or channel 51*a*, 51*b*, 51*c* and 51*d* on each corner thereof. Each indent 51*a*, 51*b*, 51*c* and 51*d* extends a distance toward the elbow section 36 from its respective open end corner. Likewise, the open end 60 of the end section 40 of the end component 32 has an indent or channel 61*a*, 61*b*, 61*c* and 61*d* on each corner thereof. Each indent 61*a*, 61*b*, 61*c* and 61*d* extends a distance toward the end section 40 from its respective open end corner. Moreover, the open end 54 of the end section 40 has a first angled lateral side 55 and second angled lateral side 56 (see e.g. FIG. 6) that together define a scoop or trough shaped open end 54. As discerned from FIGS. 1-6, the lateral sides 55, 56 extend about the lower portion of the lower section 38 when the end component 32 is in the prone position to provide a positive coupling between the two components. This feature allows the end component 34 to positively attach or couple to the elbow component 32. As shown in FIG. 4, when the tabs 48*a*, 48*b* of the end component 32 are received in the slots 46*a*, 46*b* of the elbow component 32 and the opening 60 of the end component 32 is coaxial with the end 50 of the elbow component 32 and thus in the prone position, the lateral sides 55, 56 (not seen in FIG. 4) extend about and along a portion of the lateral sides of the lower section 38 of the elbow component 32 adjacent the opening 50 thereof.

Figure 5:
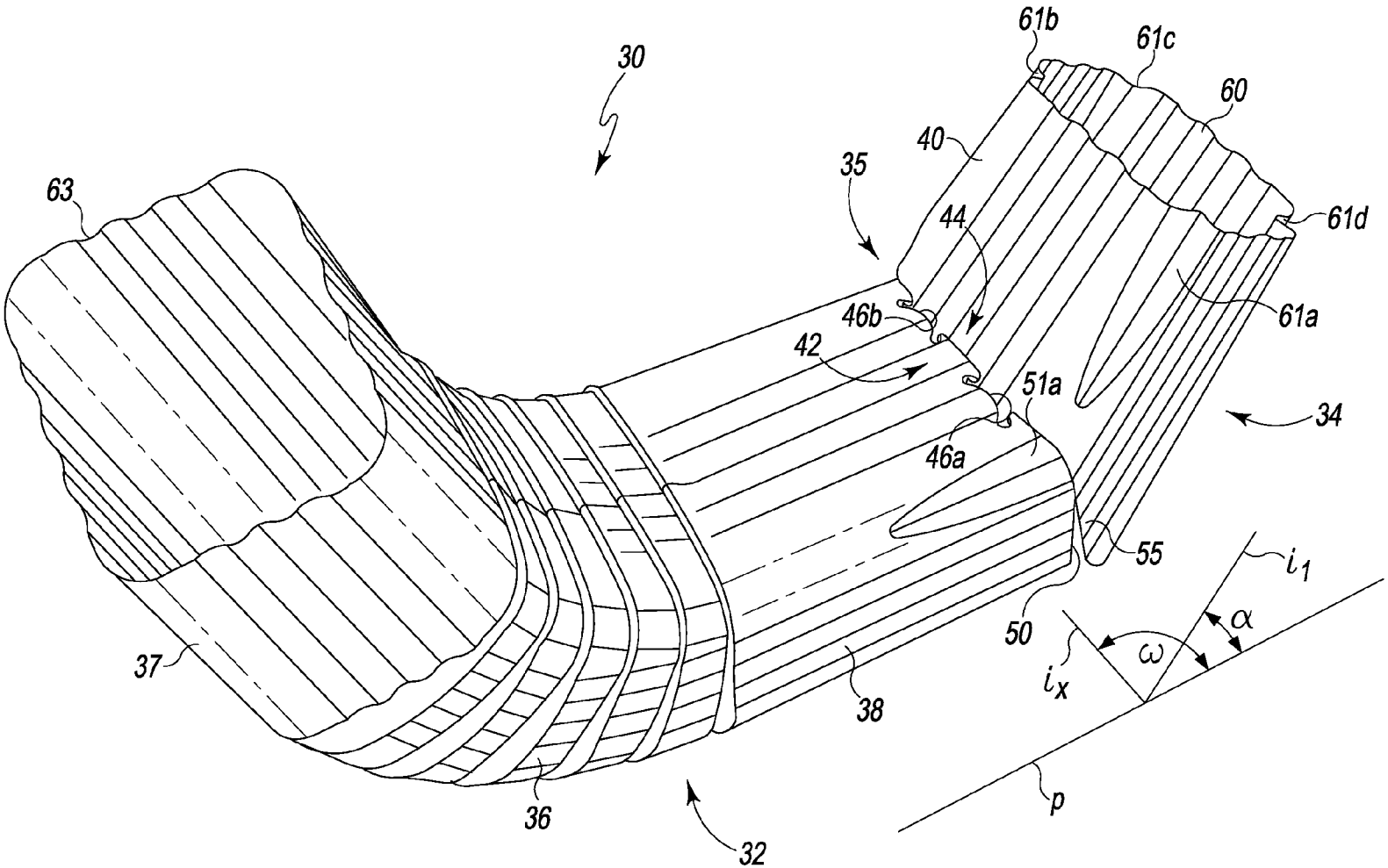
FIG. 5 is an enlarged isometric view of the assembled articulating downspout assembly of FIG. 4 with the articulating section thereof in an articulated position.

Referring to FIG. 5, the manner and extent of articulation or pivoting of the end component 34 relative to the elbow component 32 will be described. The line p represents the longitudinal axis of the lower section 38 of the elbow component 32 which is also the full prone or non-articulated position of the end component 34. The line $i_1$ represents the longitudinal axis of the end component 34 in its current position while the line $i_x$ represents the longitudinal axis of the end component 34 in its most upright or articulated position (as seen in FIG. 2). The longitudinal axis $i_1$ defines a positional angle $\alpha$ relative to the longitudinal axis p with the longitudinal axis $i_1$ defining 0° angle. It should be appreciated that the positional angle $\alpha$ is an intermediary position angle (i.e. $0° \leqq \alpha \leqq \omega$) in the continuous positions between the prone (non-articulated) position (0° angle) of the end component 34 and the most upright (articulated) position ($\omega$ angle) of the end component 34. The positional angle w is somewhat greater than 90° and represents the most upright or articulated position of the end component 34 as taken from the line $i_x$. By extending the length of the lower section 38 of the elbow component 32 more than a typical downspout elbow (not shown), the angle positional angle $\omega$ is achievable.

Figure 7:
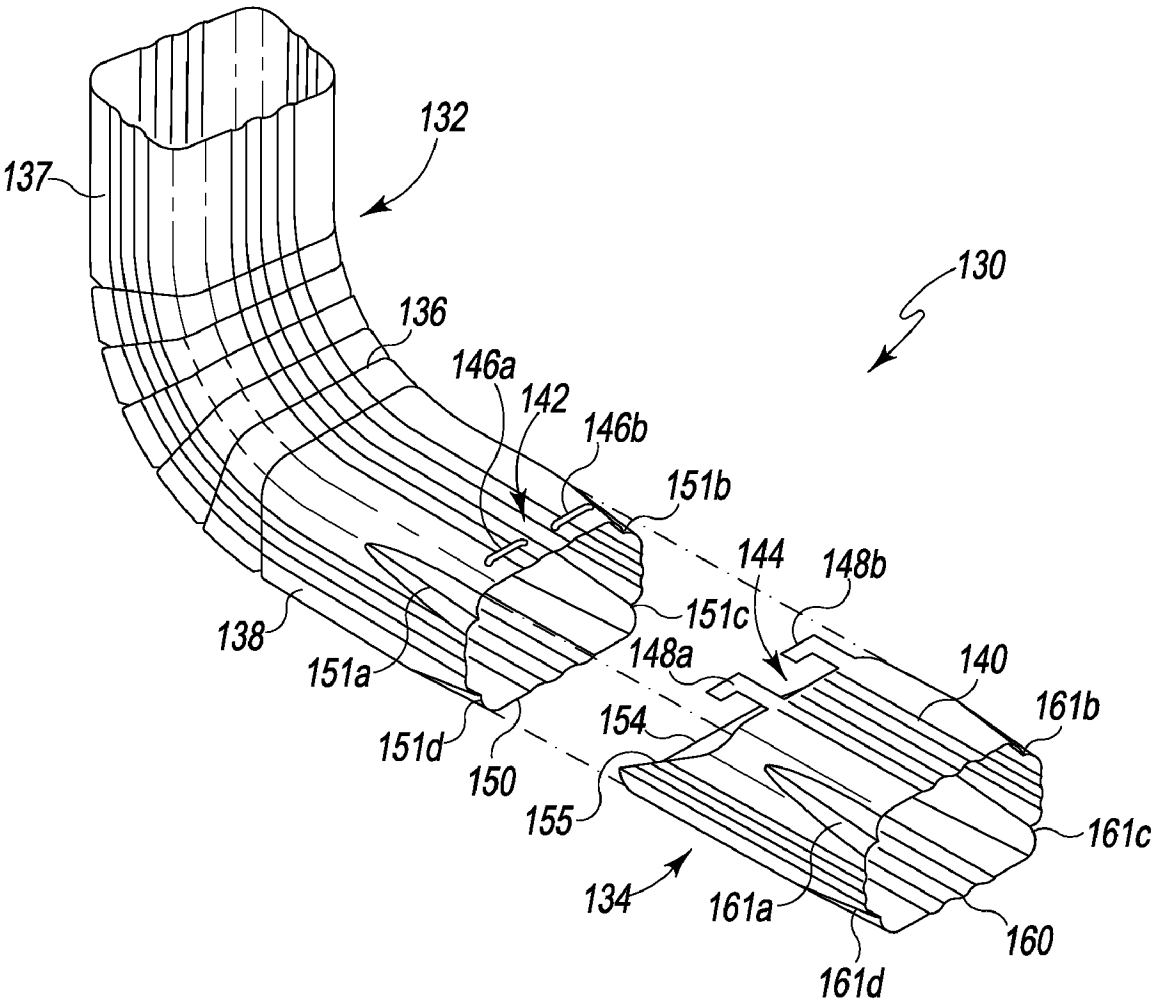
FIG. 7 is an exploded isometric view of an alternate embodiment of the present articulating downspout assembly particularly showing the elbow section and the articulating section thereof.

Referring now to FIG. 7 there is depicted another embodiment of an articulating downspout assembly, generally designated 130, fashioned in accordance with the present principles and thus having the same features, functions and general configuration as the articulating downspout assembly 30 as signified by adding "100" to the corresponding feature(s) or configuration(s) of the articulating downspout assembly 30. In this embodiment the elbow component 132 of the articulated downspout assembly 130 has an integrated pivot/hinge configuration (slot configuration) 142 comprising two generally linear elongated slots 146*a*, 146*b* formed in the upper surface of the lower section 138. The end component 134 of the articulated downspout assembly 130 has an integrated pivot/hinge configuration (tab configuration) 144 comprising two generally "L" shaped tabs 148*a*, 148*b* projecting from an upper end surface of the end section 140. The tabs 148*a*, 148*b* are thus received in the slots 146*a*, 146*b*.

Figure 8:
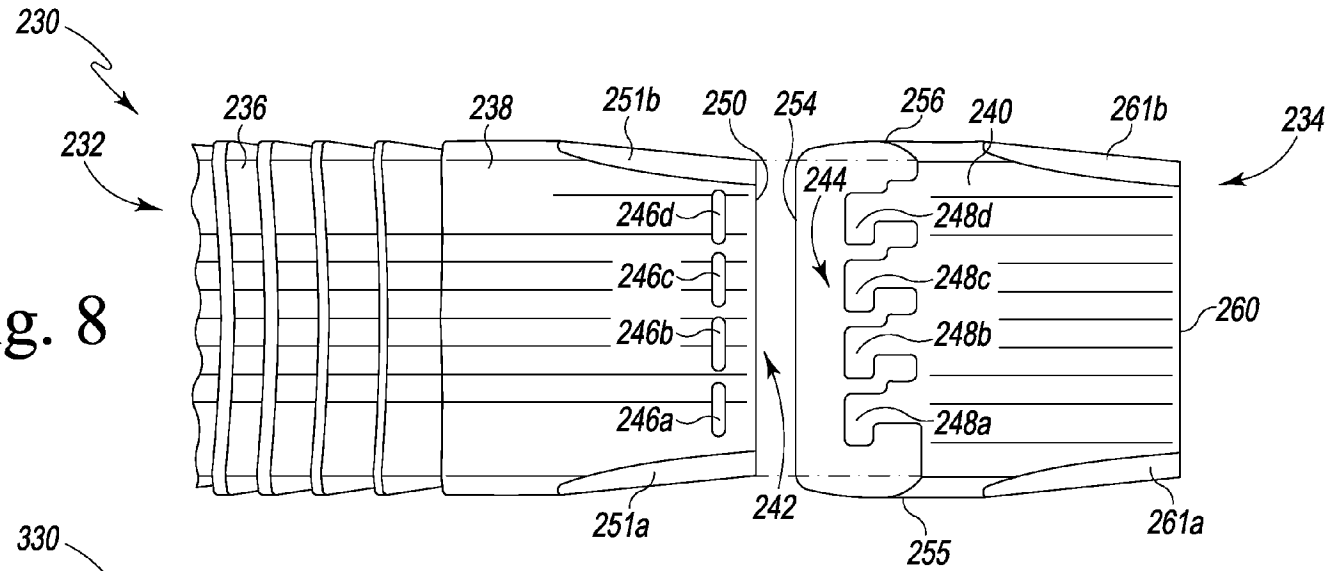
FIG. 8 is an exploded top plan view of a portion of another alternate embodiment of the present articulating downspout assembly particularly showing the end of the elbow section thereof and its configured slots along with the articulating section thereof and its configured tabs.

FIG. 8 depicts another embodiment of an articulating downspout assembly, generally designated 230 fashioned in accordance with the present principles and thus having the same features, functions and general configuration as the articulating downspout assembly 30 as signified by adding "200" to the corresponding feature(s) or configuration(s) of the articulating downspout assembly 30. In this embodiment the elbow component 232 of the articulated downspout assembly 230 has an integrated pivot/hinge configuration (slot configuration) 242 comprising four generally linear slots 246*a*, 246*b*, 246*c* and 246*d* formed in the upper surface of the lower section 238. The end component 234 of the articulated downspout assembly 230 has an integrated pivot/hinge configuration (tab configuration) 244 comprising four generally "L" shaped tabs 248*a*, 248*b*, 248*c* and 248*d* projecting from an upper end surface of the end section 240. The tabs 248*a*, 248*b*, 248*c* and 248*d* are thus received in the slots 246*a*, 246*b*, 246*c* and 246*d*.

Figure 9:
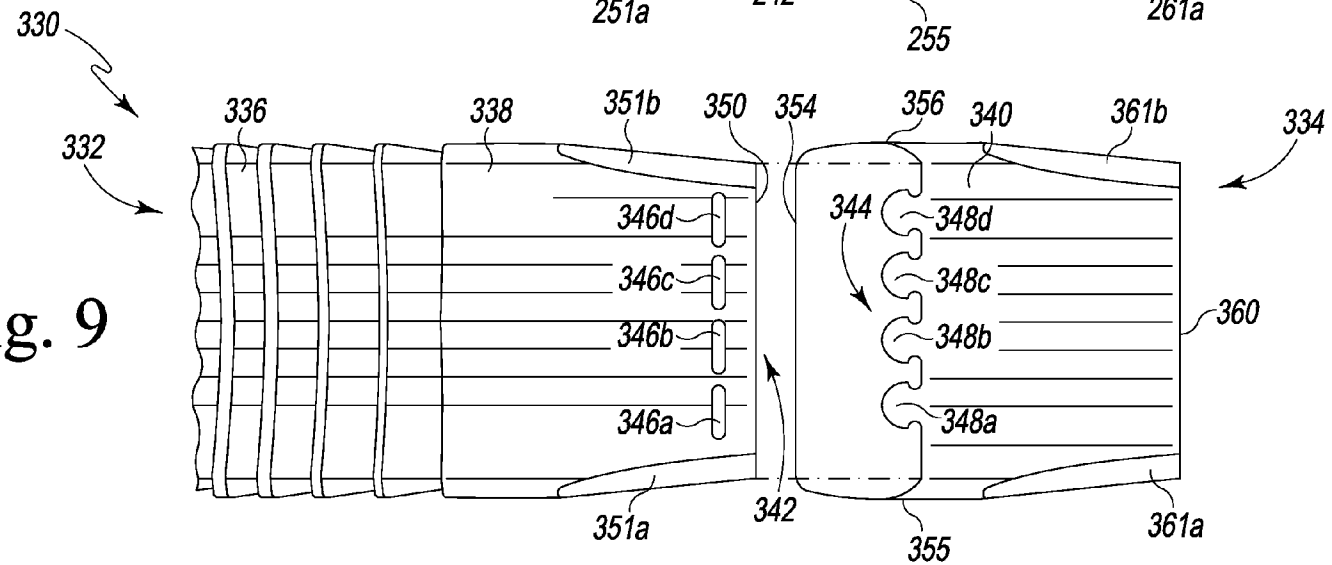
FIG. 9 is an exploded top plan view of a portion of another alternate embodiment of the present articulating downspout assembly particularly showing the end of the elbow section thereof and its configured slots along with the articulating section thereof and its configured tabs.

FIG. 9 depicts another embodiment of an articulating downspout assembly, generally designated 330 fashioned in accordance with the present principles and thus having the same features, functions and general configuration as the articulating downspout assembly 30 as signified by adding "300" to the corresponding feature(s) or configuration(s) of the articulating downspout assembly 30. In this embodiment the elbow component 332 of the articulated downspout assembly 330 has an integrated pivot/hinge configuration (slot configuration) 342 comprising four generally linear slots 346*a*, 346*b*, 346*c* and 346*d* formed in the upper surface of the lower section 338. The end component 334 of the articulated downspout assembly 330 has an integrated pivot/hinge configuration (tab configuration) 344 comprising four generally spade, spear or arrowhead shaped tabs 348*a*, 348*b*, 348*c* and 348*d* projecting from an upper end surface of the end section 340. The tabs are thus received in the slots.

Figure 10:
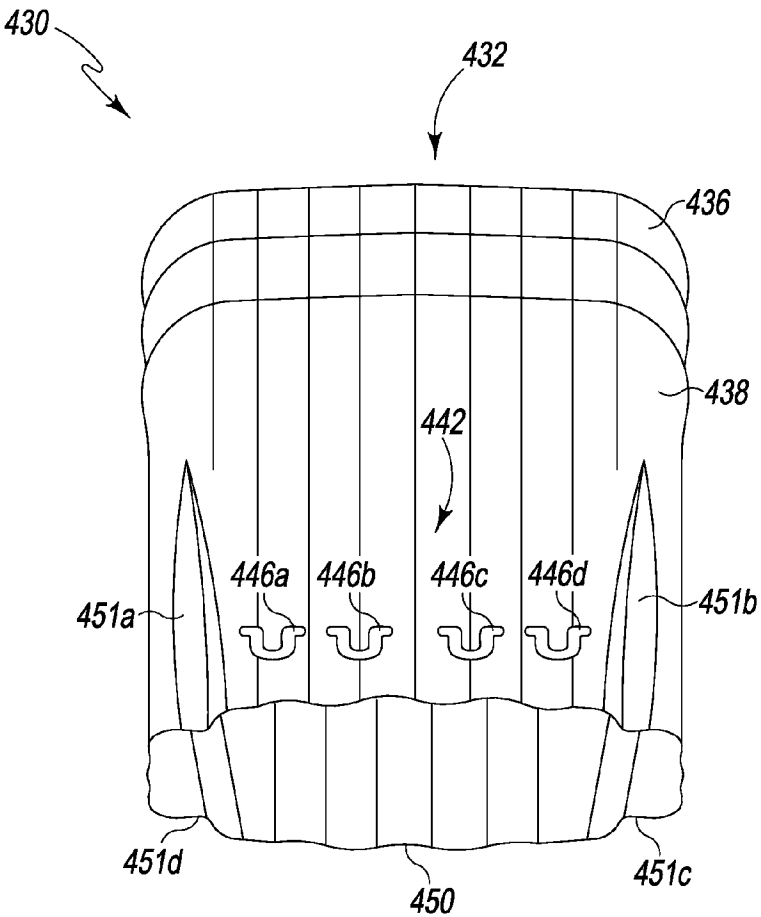
FIG. 10 is an enlarged isometric view of a portion of the end of an elbow section of another alternate embodiment of the present articulating downspout assembly particularly showing the configured slots thereof.

FIG. 10 depicts another embodiment of an articulating downspout assembly, generally designated 430 fashioned in accordance with the present principles and thus having the same features, functions and general configuration as the articulating downspout assembly 30 as signified by adding "400" to the corresponding feature(s) or configuration(s) of the articulating downspout assembly 30. In this embodiment the elbow component 432 of the articulated downspout assembly 430 has an integrated pivot/hinge configuration (slot configuration) 442 comprising four generally "U" shaped slots 446*a*, 446*b*, 446*c* and 446*d* formed in the upper surface of the lower section 438. The end component 434 (not shown) of the articulated downspout assembly 430 has an integrated pivot/hinge configuration (tab configuration) 444 comprising four complementary shaped tabs projecting from an upper end surface of the end component. The tabs are thus received in the slots.

Figure 11:
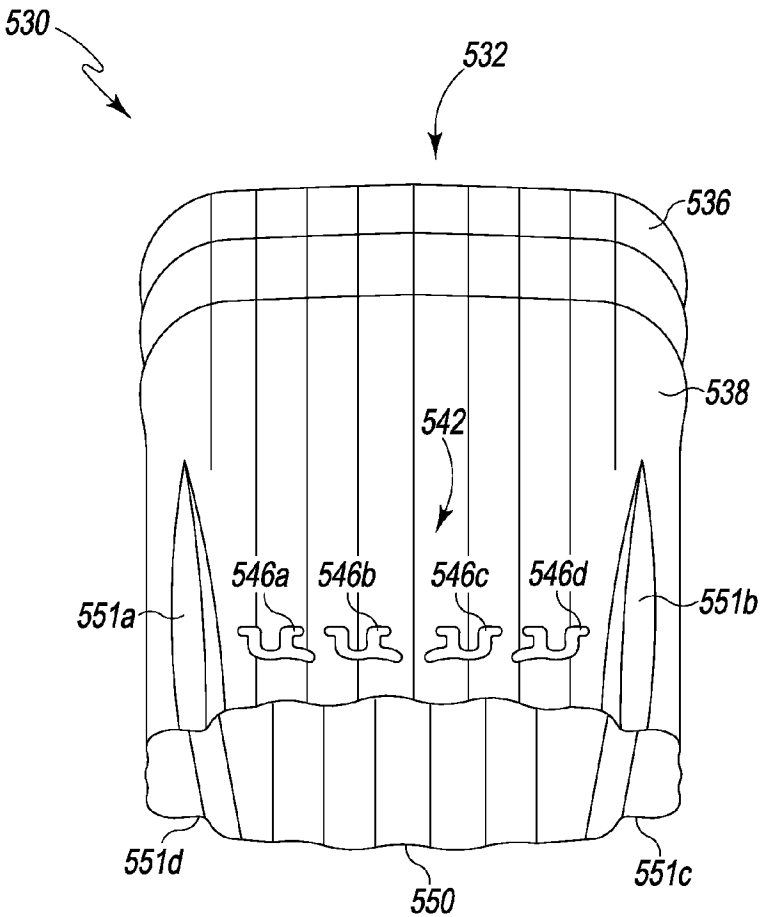
FIG. 11 is an enlarged isometric view of a portion of the end of an elbow section of another alternate embodiment of the present articulating downspout assembly particularly showing the configured slots thereof.

FIG. 11 depicts another embodiment of an articulating downspout assembly, generally designated 530 fashioned in accordance with the present principles and thus having the same features, functions and general configuration as the articulating downspout assembly 30 as signified by adding "500" to the corresponding feature(s) or configuration(s) of the articulating downspout assembly 30. In this embodiment the elbow component 532 of the articulated downspout assembly 530 has an integrated pivot/hinge configuration (slot configuration) 542 comprising four generally "modified U" shaped slots 546*a*, 546*b*, 546*c* and 546*d* formed in the upper surface of the lower section 538. The end component 534 (not shown) of the articulated downspout assembly 530 has an integrated pivot/hinge configuration (tab configuration) 544 comprising four complementary shaped tabs projecting from an upper end surface of the end component. The tabs are thus received in the slots.

Figure 12:
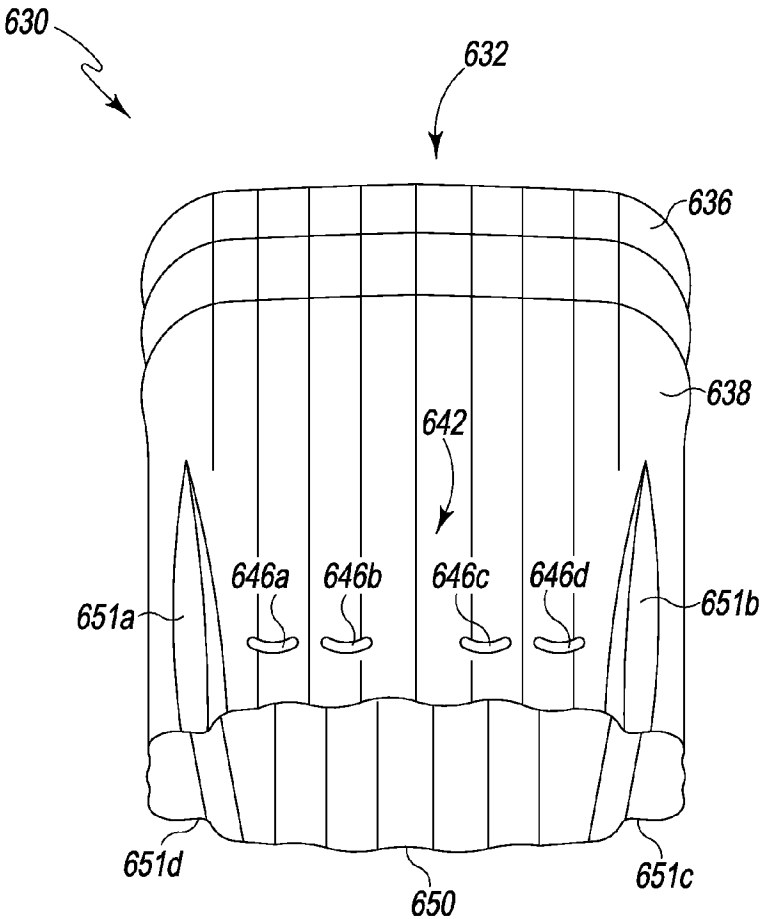
FIG. 12 is an enlarged isometric view of a portion of the end of an elbow section of another alternate embodiment of the present articulating downspout assembly particularly showing the configured slots thereof.

FIG. 12 depicts another embodiment of an articulating downspout assembly, generally designated 630 fashioned in accordance with the present principles and thus having the same features, functions and general configuration as the articulating downspout assembly 30 as signified by adding "600" to the corresponding feature(s) or configuration(s) of the articulating downspout assembly 30. In this embodiment the elbow component 632 of the articulated downspout assembly 630 has an integrated pivot/hinge configuration (slot configuration) 642 comprising four arc shaped slots 646*a*, 646*b*, 646*c* and 646*d* grouped in twos and formed in the upper surface of the lower section 638. The end component 634 (not shown) of the articulated downspout assembly 630 has an integrated pivot/hinge configuration (tab configuration) 644 comprising four complementary shaped and grouped tabs projecting from an upper end surface of the end component. The tabs are thus received in the slots.

Figure 13:
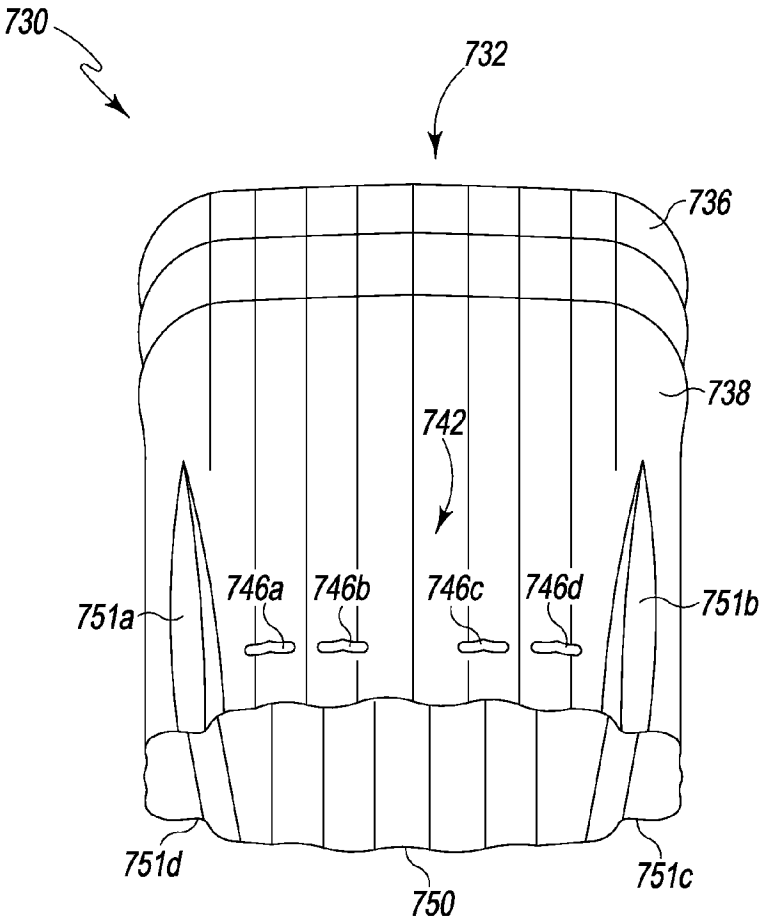
FIG. 13 is an enlarged isometric view of a portion of the end of an elbow section of another alternate embodiment of the present articulating downspout assembly particularly showing the configured slots thereof.

FIG. 13 depicts another embodiment of an articulating downspout assembly, generally designated 730 fashioned in accordance with the present principles and thus having the same features, functions and general configuration as the articulating downspout assembly 30 as signified by adding "700" to the corresponding feature(s) or configuration(s) of the articulating downspout assembly 30. In this embodiment the elbow component 732 of the articulated downspout assembly 730 has an integrated pivot/hinge configuration (slot configuration) 742 comprising four flattened caret shaped slots 746*a*, 746*b*, 746*c* and 746*d* grouped in twos and formed in the upper surface of the lower section 738. The end component 734 (not shown) of the articulated downspout assembly 730 has an integrated pivot/hinge configuration (tab configuration) 744 comprising four complementary shaped and grouped tabs projecting from an upper end surface of the end component. The tabs are thus received in the slots.

Figure 14:
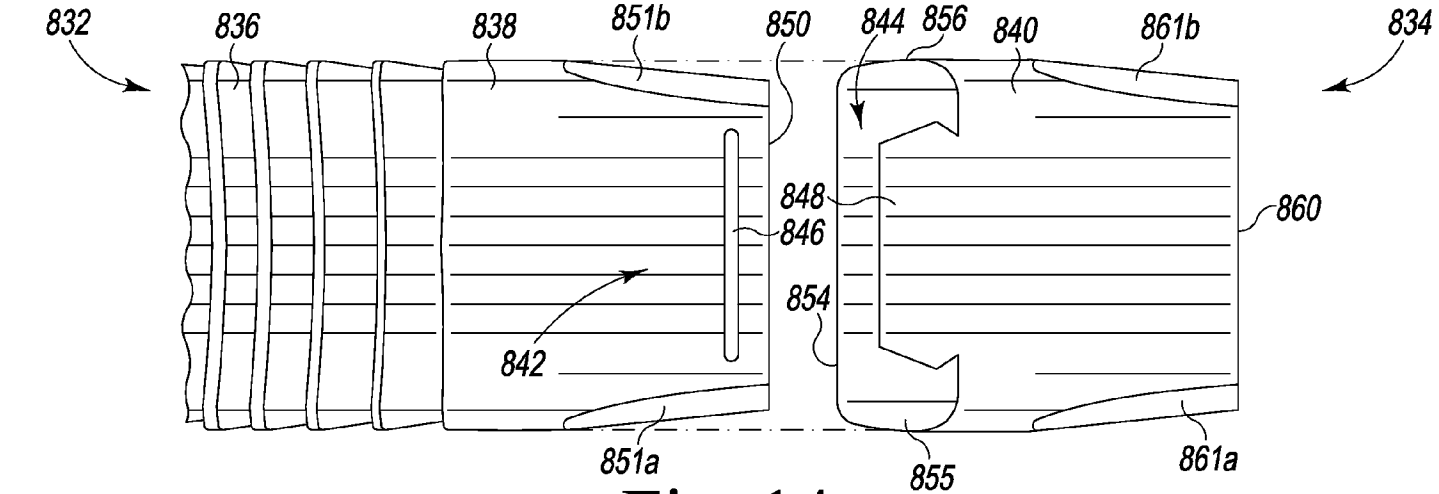
FIG. 14 is an exploded top plan view of a portion of another alternate embodiment of the present articulating downspout assembly particularly showing the end of the elbow section thereof and its configured slot along with the articulating section thereof and its configured tab.

FIG. 14 depicts another embodiment of an articulating downspout assembly, generally designated 830 fashioned in accordance with the present principles and thus having the same features, functions and general configuration as the articulating downspout assembly 30 as signified by adding "800" to the corresponding feature(s) or configuration(s) of the articulating downspout assembly 30. In this embodiment the elbow component 832 of the articulated downspout assembly 830 has an integrated pivot/hinge configuration (slot configuration) 842 comprising one generally linear elongated slot 846 formed in the upper surface of the lower section 838. The end component 834 of the articulated downspout assembly 830 has an integrated pivot/hinge configuration (tab configuration) 844 comprising one generally elongated "cereal box" shaped tab 848 projecting from an upper end surface of the end section 840. The tab is thus received in the slot. Of course, other slot/tab configurations are contemplated and thus the configurations presented herein are not to be considered exhaustive.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

What is claimed is:

1. An articulating downspout assembly comprising:

an elbow component having an upper section configured for connection to a vertical downspout of a downspout system of a building, an elbow section extending from the upper section, and a lower section extending from the elbow section, the elbow component further including a first integrated pivot configuration on the lower section comprising a slit configuration formed in an upper surface of the lower section adjacent an end of the lower section distal the elbow section; and an end component having a first end configured for coupling with a downspout extension and a second end having a second integrated pivot configuration comprising a tab configuration projecting outwardly in a longitudinal direction from an upper end surface of the end component;

the first and second integrated pivot configurations creating a hinge between the elbow component and the end component when the elbow component and the end component are joined via the first and second integrated pivot configurations.

2. The articulating downspout assembly of claim 1, wherein:

the slit configuration comprises a plurality of slits; and the tab configuration comprises a plurality of tabs.

3. The articulating downspout assembly of claim 2, wherein:

the slit configuration comprises two configured slits; and the tab configuration comprises two configured tabs.

4. The articulating downspout assembly of claim 2, wherein the end component further includes a first angled lateral side and a second angled lateral side on the second end thereof.

5. The articulating downspout assembly of claim 1, wherein the elbow component and the end component are made of aluminum.

6. An articulating downspout assembly comprising:

an elbow component having an upper section configured for connection to a vertical downspout of a downspout system of a building, an elbow section extending from the upper section, and a lower section extending from the elbow section, the elbow component further including a first integrated pivot configuration on the lower section comprising a slot configuration on an upper surface of the lower section, the slot configuration comprising two configured slots, the two configured slots being crescent shaped; and an end component having a first end configured for coupling with a downspout extension and a second end having a second integrated pivot configuration comprising a tab configuration projecting from an upper surface of the second end, the tab configuration comprising two configured tabs, the two configured tabs being arrowhead shaped;

the first and second integrated pivot configurations creating a hinge between the elbow component and the end component when the elbow component and the end component are joined via the first and second integrated pivot configurations.

7. An articulating downspout assembly comprising:

an elbow component having an upper section configured for connection to a vertical downspout of a downspout system of a building, an elbow section extending from the upper section, and a lower section extending from the elbow section, the elbow component further including a first integrated pivot configuration on the lower section comprising a slot configuration on an upper surface of the lower section, the slot configuration comprising a single slot; and an end component having a first end configured for coupling with a downspout extension and a second end having a second integrated pivot configuration comprising a tab configuration projecting from an upper surface of the second end, the tab configuration comprising a single tab;

the first and second integrated pivot configurations creating a hinge between the elbow component and the end component when the elbow component and the end component are joined via the first and second integrated pivot configurations.

8. An articulating downspout assembly comprising:

an elbow component having an upper section configured for connection to an end of a vertical downspout of a downspout system of a building, an elbow section extending from the upper section, and a lower section extending from the elbow section, the elbow component further including a first integrated pivot configuration on an upper surface of the lower section comprising a slit configuration adjacent an end of the lower section distal the elbow section; and an end component having a first end configured for coupling with a downspout extension and a second end having a second integrated pivot configuration projecting from an end of the upper surface comprising a tab configuration projecting outwardly in a longitudinal direction from an upper end surface of the end component;

the first and second integrated pivot configurations creating a hinge between the elbow component and the end component when the elbow component and the end component are joined via the first and second integrated pivot configurations.

9. The articulating downspout assembly of claim 8, wherein:

the slit configuration comprises a plurality of slits; and the tab configuration comprises a plurality of tabs.

10. The articulating downspout assembly of claim 9, wherein:

the slit configuration comprises two configured slits; and the tab configuration comprises two configured tabs.

11. The articulating downspout assembly of claim 8, wherein the end component further includes a first angled lateral side and a second angled lateral side on the second end thereof.

12. The articulating downspout assembly of claim 8, wherein the elbow component and the end component are made of aluminum.

13. An articulating downspout assembly comprising:

an elbow component having an upper section configured for connection to an end of a vertical downspout of a downspout system of a building, an elbow section extending from the upper section, and a lower section extending from the elbow section, the elbow component further including a first integrated pivot configuration on an upper surface of the lower section comprising a slot configuration having two configured slots; the two configured slots being crescent shaped; and an end component having a first end configured for coupling with a downspout extension and a second end having a second integrated pivot configuration projecting from an end of the upper surface comprising a tab configuration having two configured tabs, the two configured tabs being arrowhead shaped;

the first and second integrated pivot configurations creating a hinge between the elbow component and the end component when the elbow component and the end component are joined via the first and second integrated pivot configurations.

14. An articulating downspout assembly comprising:

an elbow component having an upper section configured for connection to an end of a vertical downspout of a downspout system of a building, an elbow section extending from the upper section, and a lower section extending from the elbow section, the elbow component further including a first integrated pivot configuration on an upper surface of the lower section comprising a slot configuration, the slot configuration comprising a single slot; and an end component having a first end configured for coupling with a downspout extension and a second end having a second integrated pivot configuration projecting from an end of the upper surface comprising a tab configuration, the tab configuration comprising a single tab;

the first and second integrated pivot configurations creating a hinge between the elbow component and the end component when the elbow component and the end component are joined via the first and second integrated pivot configurations.

* * * * *